United States Patent [19]

Long et al.

[11] 4,274,696

[45] Jun. 23, 1981

[54] ELECTRICAL CONNECTING DEVICE FOR WIRING SYSTEMS

[75] Inventors: William B. Long, Camp Hill; John A. Zimmerman, Jr., Hershey, both of Pa.

[73] Assignee: AMP Incorporated, Harrisburg, Pa.

[21] Appl. No.: 96,964

[22] Filed: Nov. 23, 1979

[51] Int. Cl.[3] ..... H01R 4/24; H01R 13/58

[52] U.S. Cl. ..... 339/103 R; 339/97 R; 339/98

[58] Field of Search ..... 339/99 R, 97, 98, 103 R; 220/3.2–3.94; 174/55, 58

[56] References Cited

U.S. PATENT DOCUMENTS

| | | | |
|---|---|---|---|
| 1,501,250 | 7/1924 | Tefft | 220/3.94 |
| 1,734,543 | 11/1929 | Thomas | 220/3.94 X |
| 3,683,319 | 8/1972 | Vigeant et al. | 339/97 R |
| 3,723,948 | 3/1973 | Wyatt | 339/99 R |
| 3,824,527 | 7/1974 | Evans | 339/97 R |
| 3,848,220 | 11/1974 | Frantz | 339/32 R |
| 3,854,114 | 12/1974 | Kloth et al. | 339/97 R |
| 3,860,739 | 1/1975 | Kloth et al. | 174/58 X |
| 3,926,498 | 12/1975 | Hoppe | 339/97 R |
| 3,935,637 | 2/1976 | Bunnell | 29/628 |
| 4,000,874 | 1/1977 | Finley et al. | 248/27.1 |
| 4,106,836 | 8/1978 | Asick et al. | 339/97 C |
| 4,191,442 | 3/1980 | Caveney et al. | 339/99 R |

FOREIGN PATENT DOCUMENTS

| | | | |
|---|---|---|---|
| 1051532 | 3/1979 | Canada | 339/98 |

*Primary Examiner*—Eugene F. Desmond

*Attorney, Agent, or Firm*—Russell J. Egan

[57] ABSTRACT

A device is disclosed for use in a wiring system for connecting conventional components, such as duplex outlets or switches, to the system. In such a wiring system insulated conductors in jacketed cables are strung about a construction and are confined within hollow walls thereof. Access to the cables is by defined apertures in wall boards with the device making an insulation displacing engagement with the conductors of the cable. The subject devices include improved terminals and cover for use in such a device to make an improved one or two conductor interconnect as well as improved means for mounting the device on a wall board or the like, a gang mounting version, and further a one piece assembly obviating the necessity for a separate face plate to cover the device and the aperture in the wall board.

2 Claims, 13 Drawing Figures

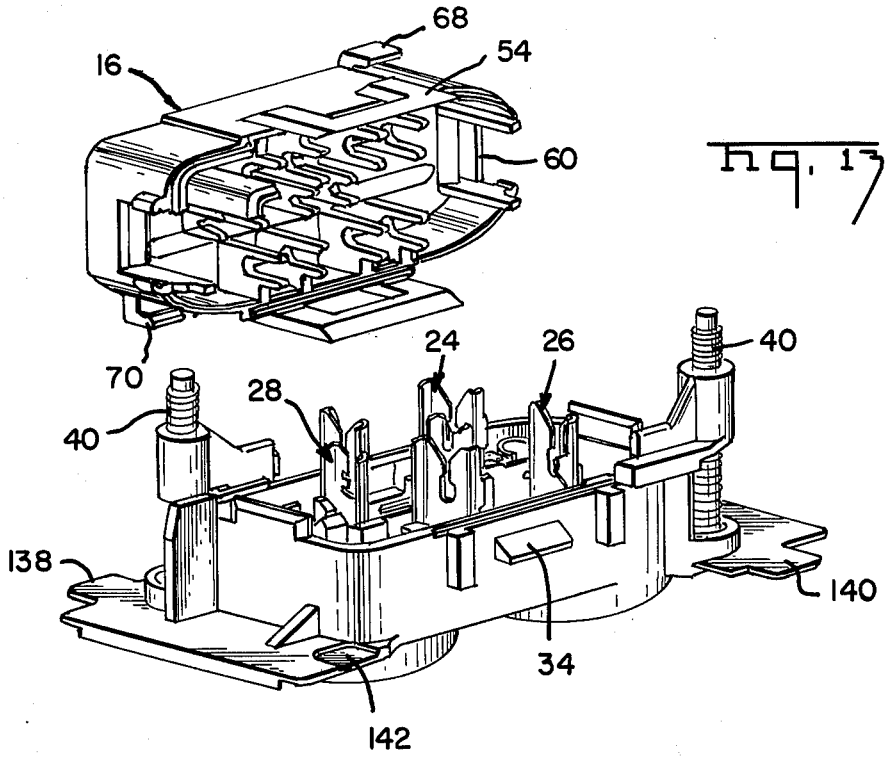
Fig. 13
Fig. 12
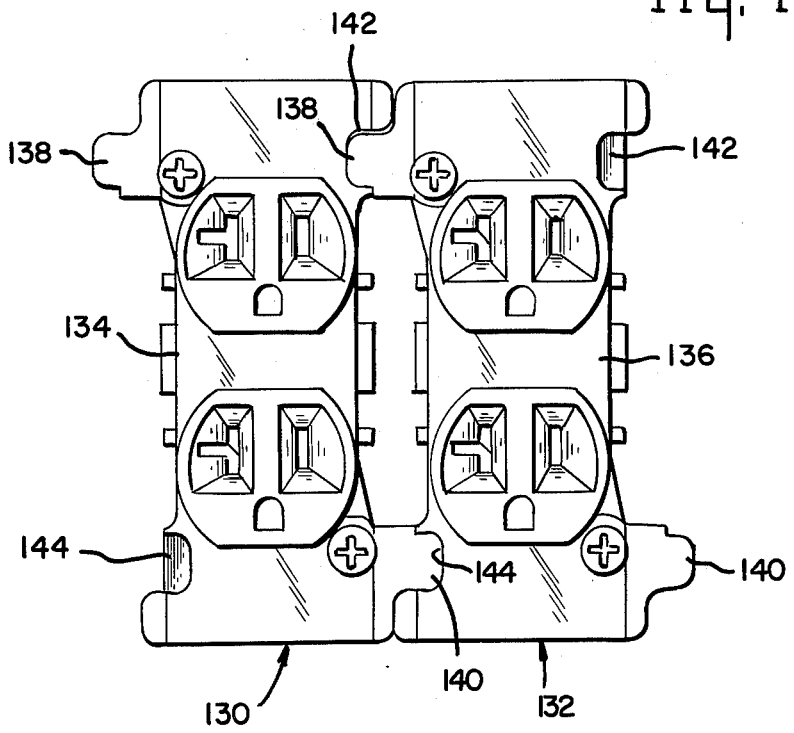

ELECTRICAL CONNECTING DEVICE FOR WIRING SYSTEMS

BACKGROUND OF THE INVENTION

1. The Field of the Invention

The present invention relates to electrical wiring systems and in particular to a device, such as a duplex outlet or switch, which can be suitably connected to such a system.

2. The Prior Art

Wiring systems for housing and modular units are well known. Initially the systems required the running of cable with individual switches and receptacles being attached to the conductors by means of screws. In order to effect the connection, the cable had to be cut, the conductors bared, bent, and secured around a screw in the receptacle. More recent innovations and cable improvement have allowed the use of cable that is fully insulated by flexible plastic materials with a plastic jacket enclosing insulated conductors. In order to terminate such a cable it is necessary to simply slit the jacket, to get access to the conductors, and then make an insulation piercing connection with the individual conductors of the cable by suitable terminals. Examples of such terminals may be found in U.S. Pat. Nos. 3,683,319; 3,848,220; and 3,854,114. There have also been a number of known mounting means whereby such a device can be secured into position in an associated sidewall, such as plaster board used in modern home building. Examples of such systems and devices can be found in U.S. Pat. Nos. 3,860,739 and 3,935,637 with a specific mounting means being shown in U.S. Pat. No. 4,000,874.

SUMMARY OF THE INVENTION

The subject device can be formed either as a duplex outlet or a switch and used in a wiring system. The device includes a housing of insulative material having means for mounting in an aperture with the mounting means including a retaining portion for securing the mounting means in a disabled condition whereby dismounting of the device is facilitated. The housing can either include an integral face plate, obviating the necessity for a separate installation, or be profiled for gang mounting in any combination of receptacles and/or switches. The device further includes an improved terminal and rear cover which will accommodate single or multiple conductors terminated in a single insulation displacing slot in a single step with assurance that adequate contact pressure will be applied to the conductor by the terminal. The subject terminal also is formed in such a manner as to obviate the previous necessity for a double wall construction which was necessary to provide adequate strain relief for the conductors engaged therein. The housing has frangible dikes which can be selectively removed for single or multiple cable connection to the device, with the cables either ending or running continuously through the device.

It is therefore an object of the present invention to produce a device for use in wiring systems which device can be readily mounted and demounted from an aperture in a wall or the like.

It is another object of the present invention to produce a device for use in house wiring situations which device can be applied to the conductors of a cable by an insulation displacing technique.

It is a further object of the present invention to produce a device for house wiring situations which can accommodate single or multiple cables either at the end of the cables or intermediate the run thereof with the cable remaining uncut.

It is a further object of the present invention to produce an improved device for house wiring situations which can be mounted in single or gang fashion.

It is yet another object of the present invention to produce a device for house wiring situations having an integral face plate so that in an installed condition the device is completely finished.

It is a still further object of the present invention to produce a device for house wiring situations which device can be readily and economically manufactured.

The means for accomplishing the foregoing objects and other advantages of the present invention will become apparent to those skilled in the art from the following detailed description taken with reference to the accompanying drawings.

BRIEF DESCRIPTION OF THE DRAWINGS

FIG. 3 is a perspective view of the rear of the subject device fully terminated on a cable;

FIG. 12 is a front elevation of a further embodiment of a duplex outlet according to the present invention with two such outlets being mounted in gang fashion; and FIG. 13 is an exploded rear perspective view of the duplex outlet embodiment of FIG. 12.

DETAILED DESCRIPTION OF THE PREFERRED EMBODIMENT

Figures 1, 2, 7:
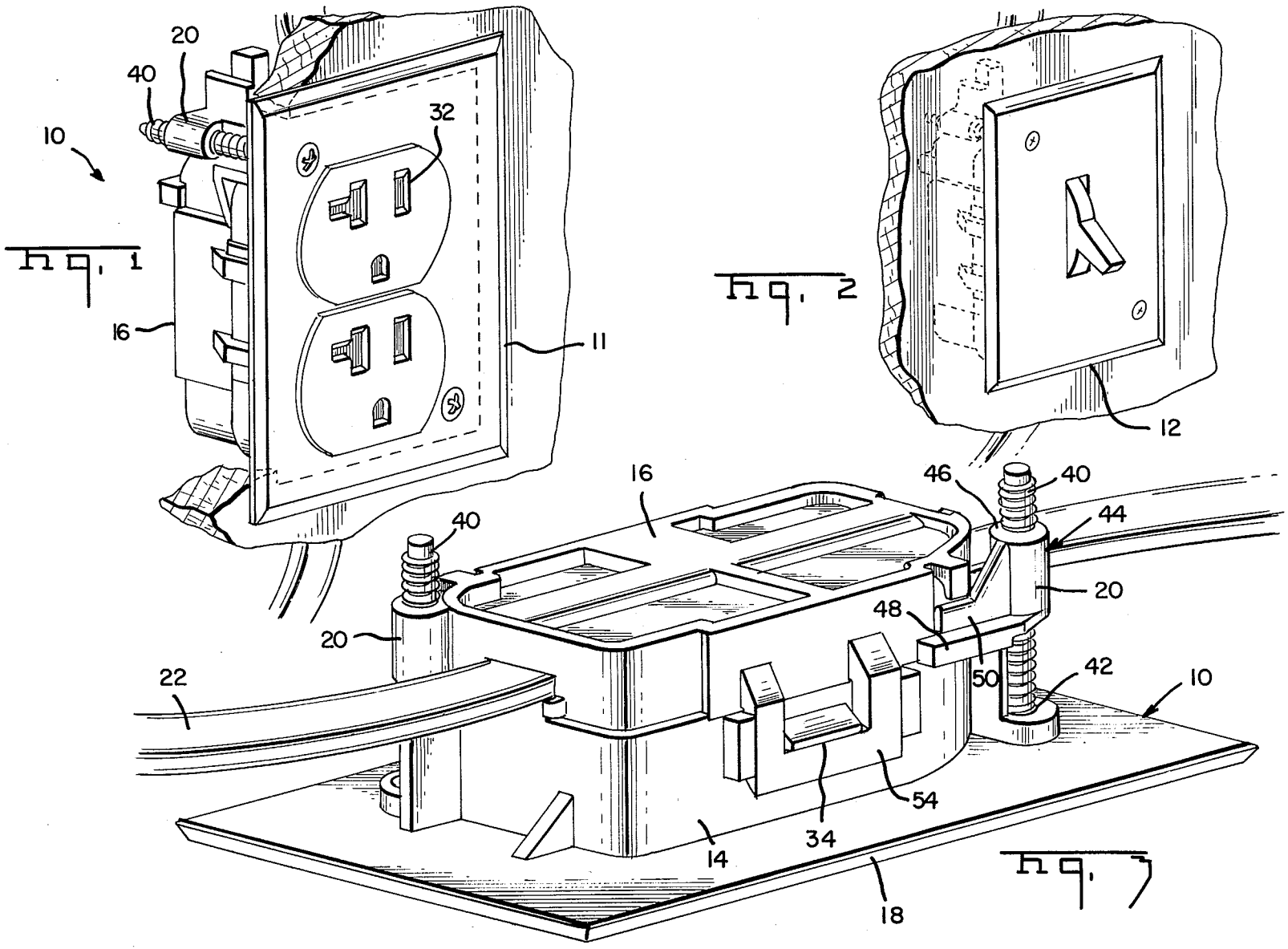
FIG. 1 is a perspective view of the front of a duplex receptacle embodiment of the present invention mounted in a wall, a portion of which is broken away.
FIG. 2 is a perspective view of a switch embodiment of the present invention mounted in a wall, part of which has been broken away.
FIG. 7 is a transverse vertical section through the subject device.

A receptacle embodiment 10 and a switch embodiment 12 are shown in FIGS. 1 and 2, respectively, each as they would appear mounted in an aperture of a wall board or the like. Since the overall mounting arrangement is quite conventional the details of the actual mounting are not shown and will not be explained, however, the mounting means will be described in detail below. The primary discussion will center around a receptacle embodiment of the subject invention. However, it should be clearly understood that much of the housing, mounting and terminal structure related to a receptacle would apply equally to a switch embodiment.

Figure 4:
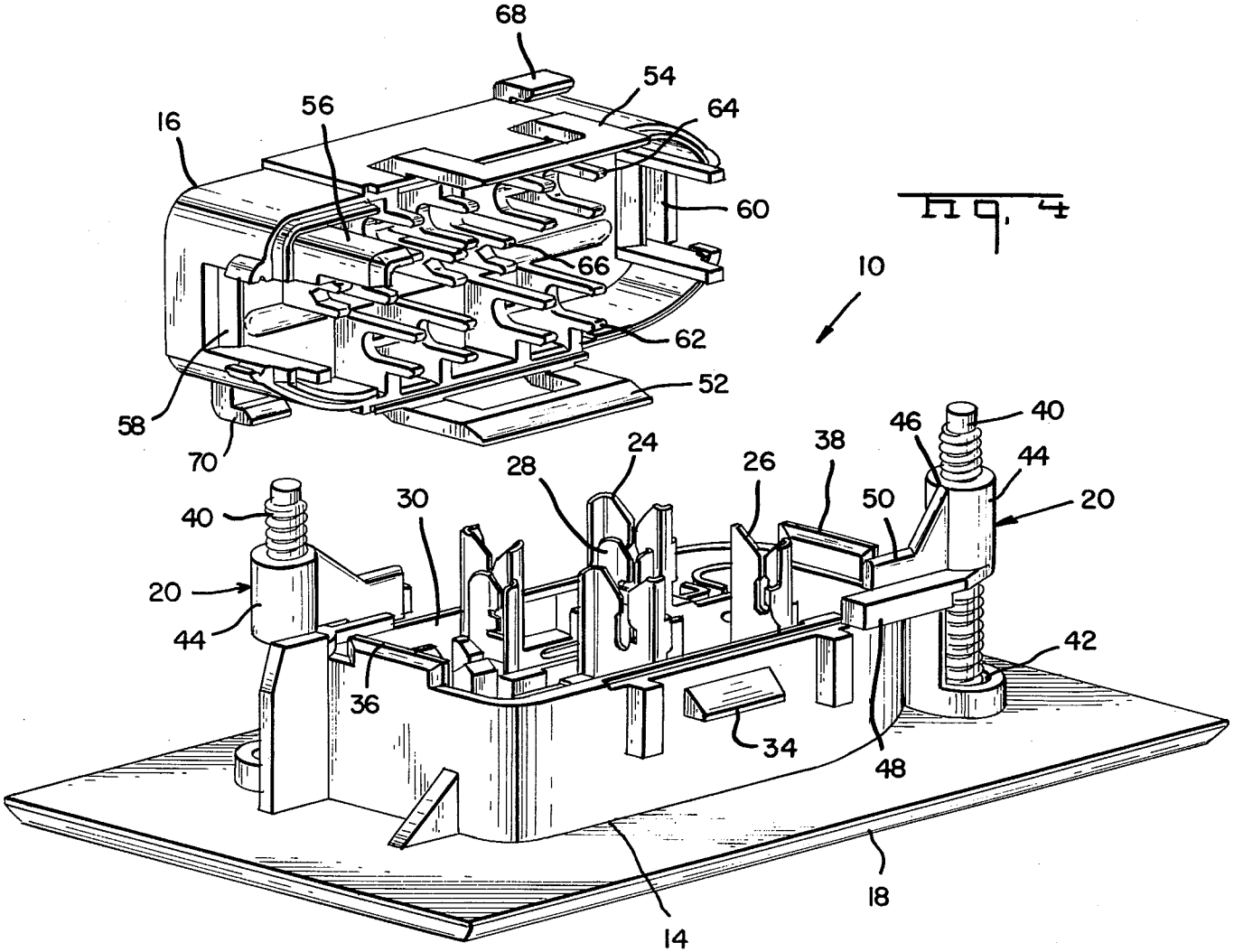
FIG. 4 is a view similar to FIG. 3 showing the cover exploded from the subject device.
Figure 5:
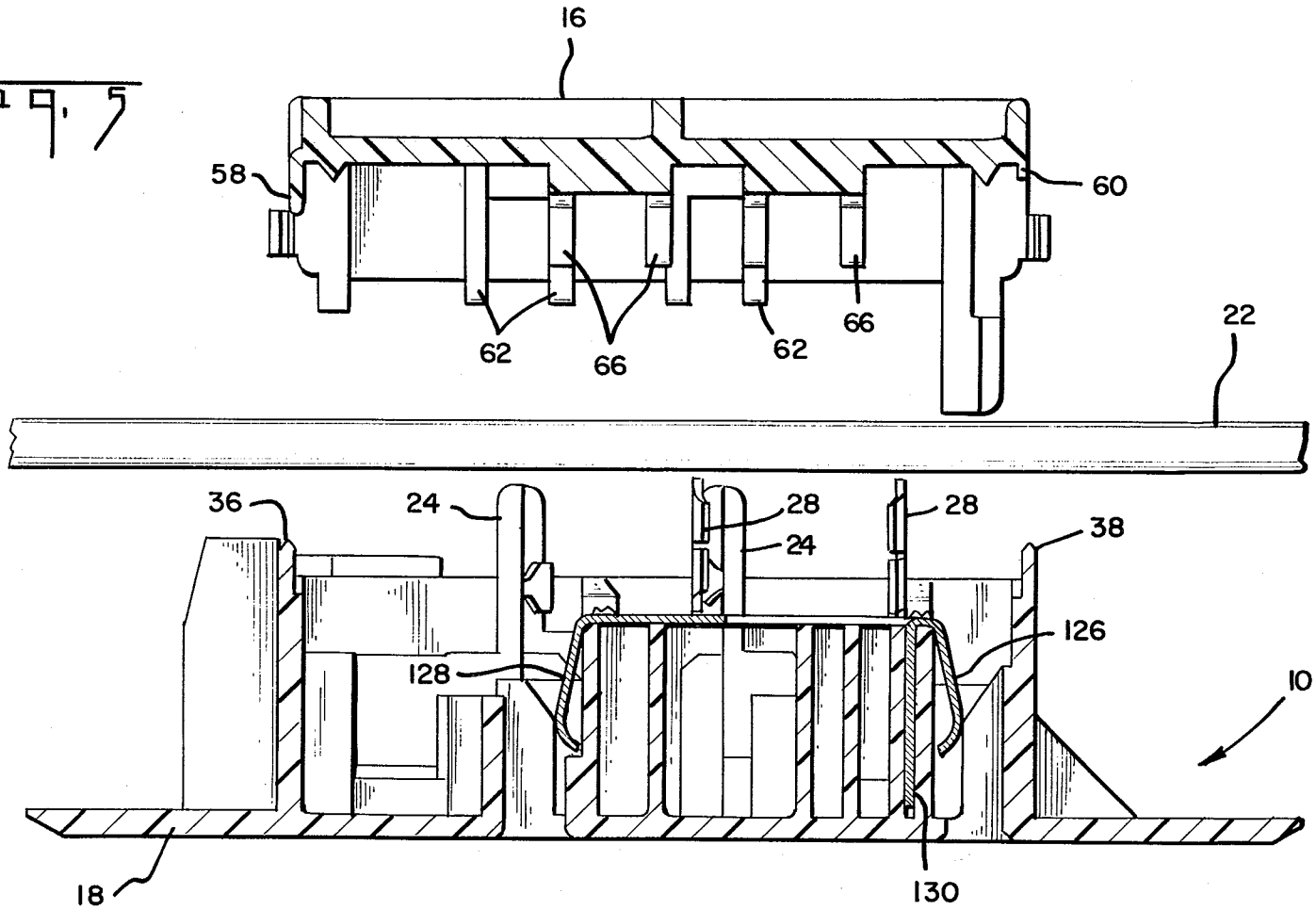
FIG. 5 is a longitudinal vertical section view taken through the subject device in an exploded condition with the cover and a cable aligned for termination thereby.
Figures 6, 7:
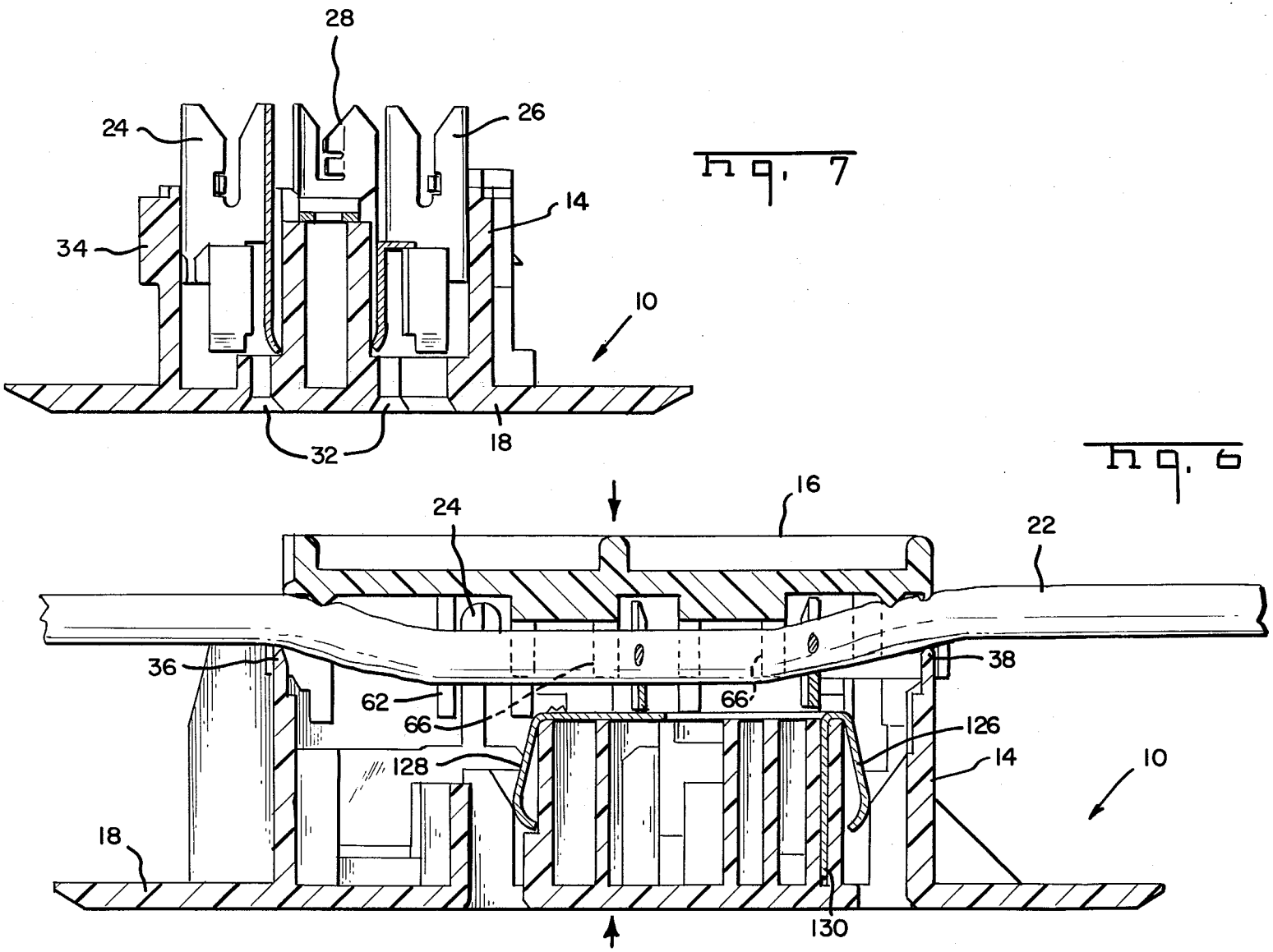
FIG. 6 is a view similar to a view of FIG. 5 with the cable fully terminated and the cover attached to the device.

Reference is made now to FIGS. 3 and 4 which show a rear perspective view of a receptacle 10 according to the present invention. The receptacle 10 includes a housing 14 with a mating cover member 16, both formed from rigid insulating material. The housing 14 includes an integral face plate 18 and mounting means 20 which are located on diammetrically opposed corners of the housing 14. A conventional electric cable 22 having two insulated conductors and a ground wire in an insulating jacket is shown passing through and terminated by the device in FIG. 3. FIG. 4 shows the rear cover 16 removed to expose the power terminals 24, 26 and the ground terminal 28.

The housing 14 defined a rearwardly directed, generally rectangular cavity 30 which has an array of apertures 32 (FIG. 1) which are shaped and aligned according to the conventional configuration for receptacles and which open into the cavity 30. The housing also has a pair of outwardly directed latching lugs 34 on opposed sidewalls and break away dikes 36, 38 at opposite ends of the housing.

The mounting means 20 each include a screw member 40 passing through an aperture 42 which opens on the front of the face plate 18 so that the exposed head of the screw can be engaged by a screwdriver or the like. The mounting means also includes a mounting lug 44 having a cylindrical portion 46 which receives the threaded screw 40 therethrough and an integral arm 48 extending normal to the axis of the cylinder 46 with a flange 50 extending rearwardly from the arm 48 in the direction of the screw 40.

The cover 16 has a profile adapted to mate with the housing 14 and includes a pair of latch members 52, 54 adapted to engage with the lugs 34. The cover also includes a polarizing prong 56 and, at opposite ends of the cover, breakaway dikes 58, 60. On the interior of the cover there are a plurality of conductor pusher members arranged in groups for pushing conductors into the respective power terminals 24, 26 and the ground terminal 28. The pusher members 62, 64, 66 are formed into groups of four blade-like members, each member having a centrally disposed recess aligned to push against the insulated conductor. The cover also includes a pair of integral holding lugs 68, 70 on diammetrically opposed corners each adapted to engage a respective flange 50 of the mounting lug 48, as will be described later.

Figure 8:
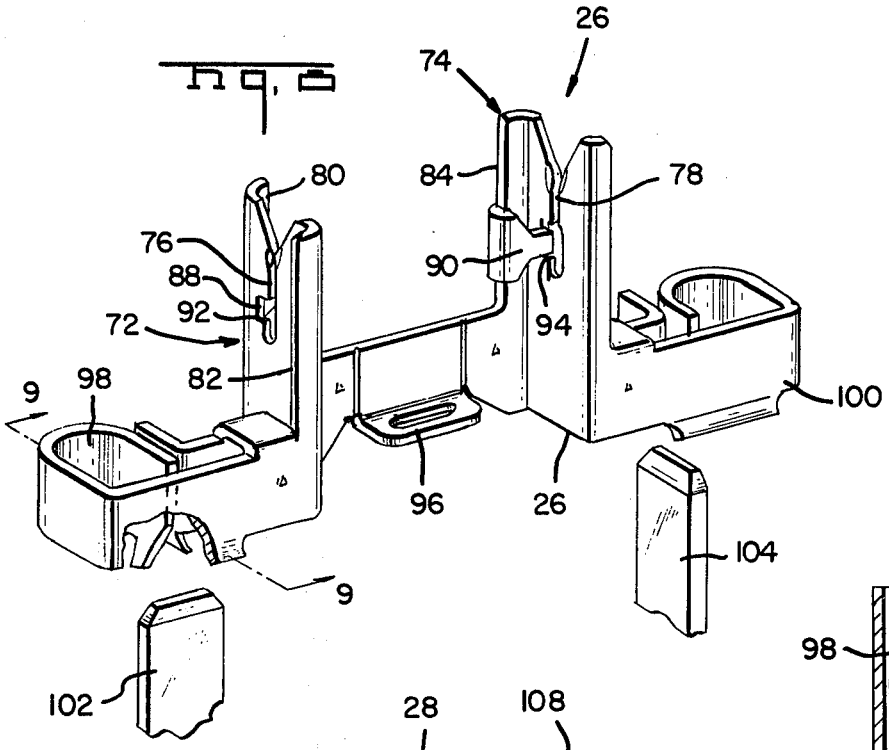
FIG. 8 is an exploded perspective view of a power terminal according to the present invention.
Figure 9:
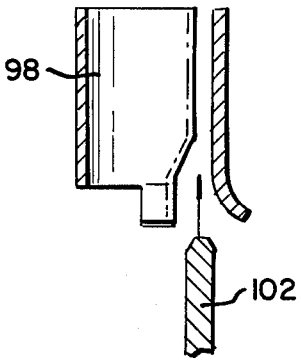
FIG. 9 is a fragment view showing the terminal of FIG. 8 receiving a blade of a mating plug.

One of the power terminals 26, 28 is shown in FIGS. 8 and 9. The terminal 26 includes a pair of conductor engaging plates 72, 74 each having a centrally disposed slot 76, 78. Each plate is provided with vertical rigidity by the flanges 80, 82, 84, 86. Each plate further includes a tine 88, 90 extending from a flange 80, 84 and folded back upon itself to engage in a recess 92, 94 in a sidewall of the respective slot 76, 78. The plates 72, 74 are joined by a tearaway strip 96. At each end of the terminal 26 there is a plug blade engaging portion 98, 100 which is folded in such fashion as to enable mating with plug blades 102, 104 in either of two orientations which are normal to each other. Various specific configurations for this blade engaging portion are well known and are described for example, in U.S. Pat. No. 3,848,220, the disclosure of which is incorporated herein by reference. Particular reference is made to FIGS. 5A through 5D of this patent which show various configurations of mating electrical plugs with the configurations relating to specific power requirements.

Figure 10:
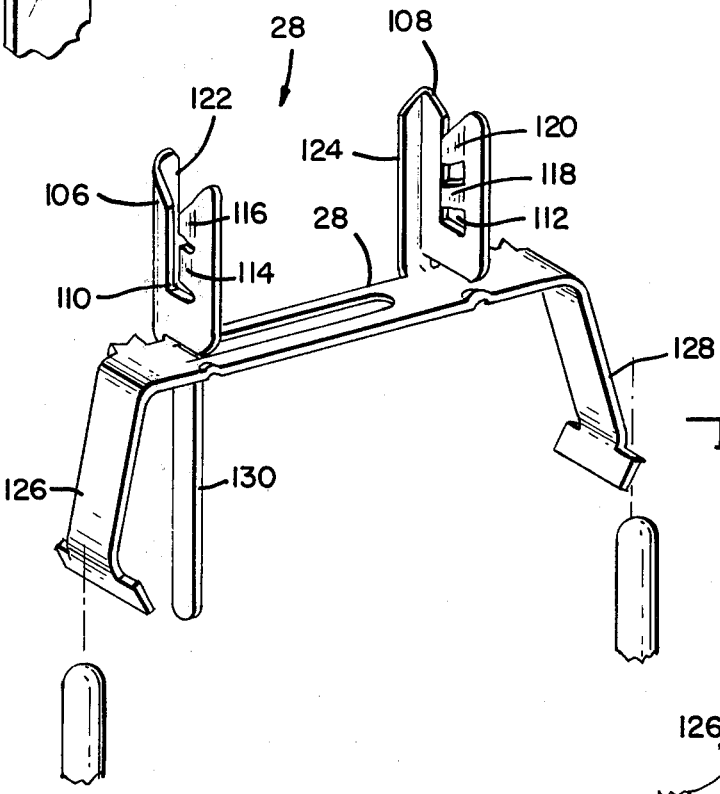
FIG. 10 is an exploded perspective view of the ground terminal according to the present invention.
Figure 11:
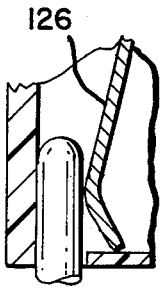
FIG. 11 is a detailed view of the ground terminal of FIG. 10 engaging a ground plug.

The ground terminal 28 is shown in FIGS. 10 and 11 and includes a pair of plates 106, 108 each with a centrally disposed slot 110, 112 with one sidewall of the slot being formed by a pair of inwardly directed tines 114, 116, 118, 120. The plates 106, 108 also each include a side flange 122, 124, respectively, to provide strength for the plate during insertion of a wire into the slots. The ground terminal also includes a pair of mating blades 126, 128 at the opposite ends thereof. Each blade is provided with outwardly directed shoulders which can be used to locate the blade within the housing. The downwardly directed tine 130 can be used for stabilization or grounding gang assemblies.

A gang mounting duplex version of the subject invention is shown in FIGS. 12 and 13. Each duplex unit 130, 132 is identical and, with the exception of the integral face plate 18, is the same as the previously described duplex 10. Each duplex housing 134, 136 has at least two oppositely directed and laterally extending tabs 138, 140 which are received in like recesses 142, 144 to correctly align and space the units as shown in FIG. 12. The perspective view of FIG. 13 more clearly shows how the tabs and recesses interact to relatively position the units. The terminals 24, 26 and 28, mounting means 40 and cover 16 used with this embodiment are identical with those previously discussed. The only difference is the integral face plate 18 is omitted from the housing. Therefore a gang of these units would require the addition of an appropriate multi-unit face plate (not shown).

The subject device is assembled in a known manner with the respective power and ground terminals 24, 26, 28 simply being inserted from the rear of the open housing. The mounting means are assembled by driving the screw 40 through the aperture 42 to engage in the cylinder 46 portion of the mounting lug 44.

In order to terminate a cable 22 it is necessary to split the insulation shield to expose the insulated conductors and ground wire carried thereby. The conductors and ground wire are profiled in a known manner, as shown in U.S. Pat. Nos. 3,860,739 and 3,935,637, to be substantially aligned with the plate portions of the respective terminals. Before placing the cables into the cover, it is necessary to break away one or more of the dikes 36, 38 58, 60 of the housing and/or the cover, respectively, according to whether one or two cables are being used and whether or not these cables are through cables or have a free end to be located within the device. The cables are placed in the cover with the conductors lying within the color identified recesses. A special feature of this design is that it is not necessary to install one conductor level at a time, removing the cover to install the second conductor level. The cover will properly install all conductors in a single closing. The cover is then applied with the members 62, 64, 66 engaging the respective conductors and driving them into their correct terminal plates. The polarizing prong 56 assures correct orientation of the cover with respect to the housing. It should be here noted, and with reference to FIG. 8, that the first conductor driven into a terminal will be driven into the lowest position. Here it will be engaged by one sidewall of the slot 76, 78 and by the free end of the tine 88, 90. These tines are oppositely directed along the conductor and thus will serve a strain relief function, much as that described in U.S. Pat. No. 3,854,114 but with the requirement of only a single plate rather than a double plate. The tines provide a further function of strain relief for the plate. In any slotted plate termination the first wire driven into the plate will cause the sidewalls to be deflected outwardly to a certain extent. In some instances it may not be possible for the sidewalls to recover sufficiently so that the spacing between the sidewalls is adequate to accept the second conductor in the same slot. The tines 88, 90 will allow compensation for any overstresssing of the sidewalls with the overstress being taken up by the tine and the sidewalls being allowed to return to their original positioning. A similar conductor strain relief and plate strain relief function is achieved by the tines 114, 116, 118, and 120 of the ground terminal 28.

The mounting means 20 is arranged such that when the screw 40 is initially rotated, the mounting lug 44 will initially rotate with the screw until it engages the adjacent sidewall of the housing. At this point the lug 44 will not rotate further but will be drawn along the threads of the screw 40 until it rests tightly against the wall to hold the device in a clamped condition with the lugs 48 on the first side of the wall and the mounting face plate 18 engaging the opposite side. Thus far this appears to be a rather conventional arrangement and is shown in FIGS. 1 and 2. However, to dismount the subject device, the screws 40 are driven in the reverse direction which initially loosens the clamping engagement of the lugs 44 with the wall and allows the lugs to rotate back against the housing to the positions shown in FIGS. 3 and 4. The continued rotation of the screws will cause the lug to ride out on the threads until the flanges 50 enter into the lugs 68, 70. Thus there is assurance that the lugs have been appropriately positioned clear of the aperture in the wall board so that the unit can be withdrawn from the wall without the lugs 44 either engaging and damaging the profile of the aperture or being broken.

The present invention may be subject to many modifications and changes without departing from the spirit or essential characteristics thereof. The present embodiment is therefore to be considered in all respects as illustrative and not restrictive of the scope of the invention.

We claim:

1. An electrical device capable of terminating a wiring system of the type formed by three or four conductor cables enclosed in an insulating jacket, said device comprising:

a generally rectangular housing of rigid insulating material having at least one access opening in a forward face and a rearwardly directed cavity;

at least two terminals mounted in said cavity, each said terminal having at least one rearwardly directed conductor plate each with an insulation displacing slot therein, a recess in a sidewall of said slot toward the bottom of each said slot, a tine extending from an outer edge of said plate and being folded back upon itself to lie in a respective recess, said tine biting into a respective conductor at an acute angle thereby acting as a strain relief for said conductor;

a cable receiving cover member profiled to mate with said housing to enclose said cavity, said cavity and said cover member being polarized, said cover member having means to latchingly secure it to said housing and defining a cable passage with pusher means therein for each conductor of said cable; and mounting means to detachably secure said device in an aperture of a wall or the like.

2. An improved terminal for effecting an insulation displacing termination of an insulated electrical conductor, said terminal comprising:

a plate member having opposed side walls defining a slot therebetween, a notch formed in one sidewall of said slot and entering into said slot near a closed end thereof, a tine formed on an outer edge of said one sidewall and folded upon itself with the free end of said tine resting in said notch, said tine and notch being so located as to engage a first conductor inserted in said slot with the tine allowing for deflection upon insertion of a respective conductor into the slot with the tine and the opposite sidewall engaging the conductor, said sidewalls remaining uniformly spaced whereby a second conductor can be engaged by the plate.

* * * * *